US006050809A

United States Patent [19]

Fayerman

[11] Patent Number: 6,050,809

[45] **Date of Patent: *Apr. 18, 2000**

[54] IMMERSION TUBE BURNER WITH IMPROVED FLAME STABILITY

[75] Inventor: Matvey Fayerman, Rockford, Ill.

[73] Assignee: Eclipse Combustion, Inc., Rockford, Ill.

[ * ] Notice: This patent is subject to a terminal disclaimer.

[21] Appl. No.: 08/935,765

[22] Filed: Sep. 23, 1997

[51] Int. Cl.[7] ..... F23S 14/48

[52] U.S. Cl. ..... 431/114; 431/10; 431/353; 431/181; 431/187; 431/243; 431/350; 239/434

[58] Field of Search ..... 431/354, 114, 431/181, 350, 353, 343, 348, 187, 10, 346; 239/433, 402.5, 403, 404, 405, 406, 434

[56] References Cited

U.S. PATENT DOCUMENTS

| | | | |
|---|---|---|---|
| 2,375,840 | 5/1945 | Ekstrom, Jr. . | |
| 3,574,508 | 4/1971 | Rothhar et al. | 431/351 |
| 4,014,316 | 3/1977 | Jones et al. | 126/360 R |
| 5,049,066 | 9/1991 | Kaiya et al. | 431/352 |
| 5,195,884 | 3/1993 | Schwartz et al. | 431/8 |
| 5,263,849 | 11/1993 | Irwin et al. | 431/6 |
| 5,344,307 | 9/1994 | Schwartz et al. | 431/9 |
| 5,399,085 | 3/1995 | Taylor | 431/243 |
| 5,486,108 | 1/1996 | Kubota | 431/181 |
| 5,494,437 | 2/1996 | Kubota et al. | 431/350 |
| 5,520,537 | 5/1996 | Taylor | 431/8 |
| 5,542,839 | 8/1996 | Kelly | 431/10 |
| 5,554,022 | 9/1996 | Nabors, Jr. et al. | 431/10 |
| 5,839,891 | 11/1998 | Cook | 431/350 |
| 5,934,898 | 8/1999 | Fayerman | 431/353 |

OTHER PUBLICATIONS

Rhine, J.M. and Tucker, R.J., "Modeling of Gas–Fired Furnaces and Boilers" published in 1991, pp. 32–34.

Arutynov, V.A., Mitklinniy, U.I., and Stark, S.B., "Metallurgical Heat Technology, vol. 1, Fundamentals, Fuel and Refractory", published in 1974, pp. 242–244. A brief translation of the figures appearing on those pages is attached thereto.

*Primary Examiner*—Carl D. Price

*Attorney, Agent, or Firm*—Leydig, Voit & Mayer, Ltd.

[57] ABSTRACT

An immersion tube burner having stable ignition and flame over a wide range of firing rates. The burner includes a restriction orifice located between the fan and the burner nozzle for minimizing pulsations of air pressure fluctuations between the fan and nozzle. The orifice is sized so that the air velocity is greater through the orifice than at the nozzle so that any such pulsations are directed downstream of the nozzle rather than upstream, where they can affect the flame. The burner includes a burner nozzle having a cone shaped mixing plate. The angled shape of the plate re-circulates hot gases towards the base of the flame to thereby ensure more consistent ignition and combustion. The mixing plate further has holes arranged in primary and secondary zones. The holes of the primary zone are located within approximately five times the diameter of the fuel outlet ports so that the fuel exiting such ports has sufficient velocity to optimize mixing. The holes in the secondary zone are located farther away from the ports so that minimal mixing takes place inside the combustion chamber. Instead, the air and fuel from the secondary zone mix more completely in the immersion tube and subsequently combust. Accordingly, the present invention provides an immersion tube burner with improved flame stability during ignition and operation and improved control over the amount of combustion taking place inside the combustion chamber and the immersion tube.

16 Claims, 2 Drawing Sheets

IMMERSION TUBE BURNER WITH IMPROVED FLAME STABILITY

FIELD OF THE INVENTION

The present invention generally relates to burners, and more particularly relates to burners for heating immersion tubes.

BACKGROUND OF THE INVENTION

Immersion tube burners are used in the wide range of industrial applications to heat liquid carried in tanks. The burner is typically attached to an immersion tube which follows a serpentine path in the tank. The tank is full of liquid and the tube is submerged in the liquid so that when the burner heats the tube, the tube in turn heats the liquid.

A fan is typically connected to the burner to supply combustion air. Fuel supply apparatus is also attached to the burner to provide fuel to the burner system. A nozzle in the burner mixes air and fuel to obtain a combustible mixture which is then ignited.

In immersion tube burners, it is desirable to have a majority of combustion take place downstream to maximize the amount of heat delivered by the tube heat exchanger. A certain amount of combustible mixture is, however, needed at the burner nozzle to maintain flame. The air and fuel which does not combust at the nozzle flows downstream from the burner to mix and combust in the immersion tube attached to the burner, thereby heating the immersion tube. By increasing the amount of combustion taking place in the tube, rather than at the burner, the efficiency of the immersion tube burner is increased.

Unfortunately, a significant problem with previously known immersion tube burners is maintaining a stable, and therefore efficient, flame at relatively low air supply pressures. In a typical burner system, the air and fuel flow must overcome back pressures in the burner system. The back pressure is increased in the case of an immersion tube burner because of the additional pressure drops associated with a plurality of 180 degree bends which form the serpentine path of the tube. As a result, the typical immersion tube burner system experiences air pressure fluctuations which, in conventional immersion tube burners, create pulsations between the burner nozzle and the fan. The air pressure pulsations create flame instability. An unstable flame further increases the pressure fluctuations since the amount of air and fuel actually burned in the system varies. Accordingly, a cyclical effect occurs in conventional immersion tube burners in which pressure fluctuations create an unstable flame and flame instability aggravates the pressure fluctuations.

The pressure fluctuations cannot be satisfactorily controlled using a butterfly valve. Immersion tube burners typically employ a butterfly valve in the combustion air inlet line between the fan and the burner to control the volume of air entering the burner. To address pulsations, the butterfly valve must always be partially closed so that it creates a pressure drop in the air inlet line. The butterfly valve therefore may never be fully open, thereby limiting the controlled range of motion of the valve.

Some conventional burners have a further problem producing stable combustion at high firing rates when first ignited. It is often desirable to run the immersion tube burner at or near its heating capacity during system start-up. Conventional immersion tube burners, however, have difficulty maintaining a stable flame at higher firing rates when first ignited. A previously known burner addresses this problem by providing a pilot assembly which warms the combustion chamber before running at high fire. The pilot assembly, however, wastes time and money since the user must wait for the pilot to heat the combustion chamber before running the burner at high fire.

SUMMARY OF THE INVENTION

A general aim of the present invention is to provide an immersion tube burner with improved flame stability characteristics.

In that regard, it is an object of the present invention to provide an immersion tube burner which reduces the pulsation of pressure fluctuations between a fan and a burner nozzle incorporated in the tube burner.

It is a related object of the present invention to provide an immersion tube burner having stable combustion at low and high firing rates.

A detailed object of the present invention is to provide an immersion tube burner which adequately mixes air and fuel over a wide range of firing rates.

It is a feature of the present invention that the housing of an immersion tube burner has a restriction orifice located at an air inlet between the fan and the burner nozzle. The restriction orifice creates an additional pressure drop between the fan and the burner nozzle and is sized so that the air velocity through the orifice is greater than the air velocity at the burner nozzle. Accordingly, changes in air pressure are forced downstream of the burner nozzle rather than pulsating between the burner nozzle and the fan.

A further feature of the present invention is to provide a mixing plate having a primary hole zone which maximizes mixture of fuel and air supplied to the zone and a secondary hole zone which supplies fuel and air for mixing in the immersion tube. The primary zone is located nearest the center of the burner nozzle and has holes located within a pre-determined distance from the fuel outlet ports. Fuel exiting the outlet ports will maintain a relatively constant velocity for a given distance. The holes of the primary zone are located within this distance so that the mixture of fuel and air is optimized in the primary zone. A secondary zone of holes is located near the periphery of the mixing plate. The secondary zone is located at a distance from the outlet ports at which the fuel velocity has substantially decayed. As a result, the fuel travels substantially parallel to the air and mixing therefore takes place further downstream of the burner nozzle.

These and other objects and advantages of the invention will become more apparent from the following detailed description when taken in conjunction with the accompanying drawings.

Figure 1:
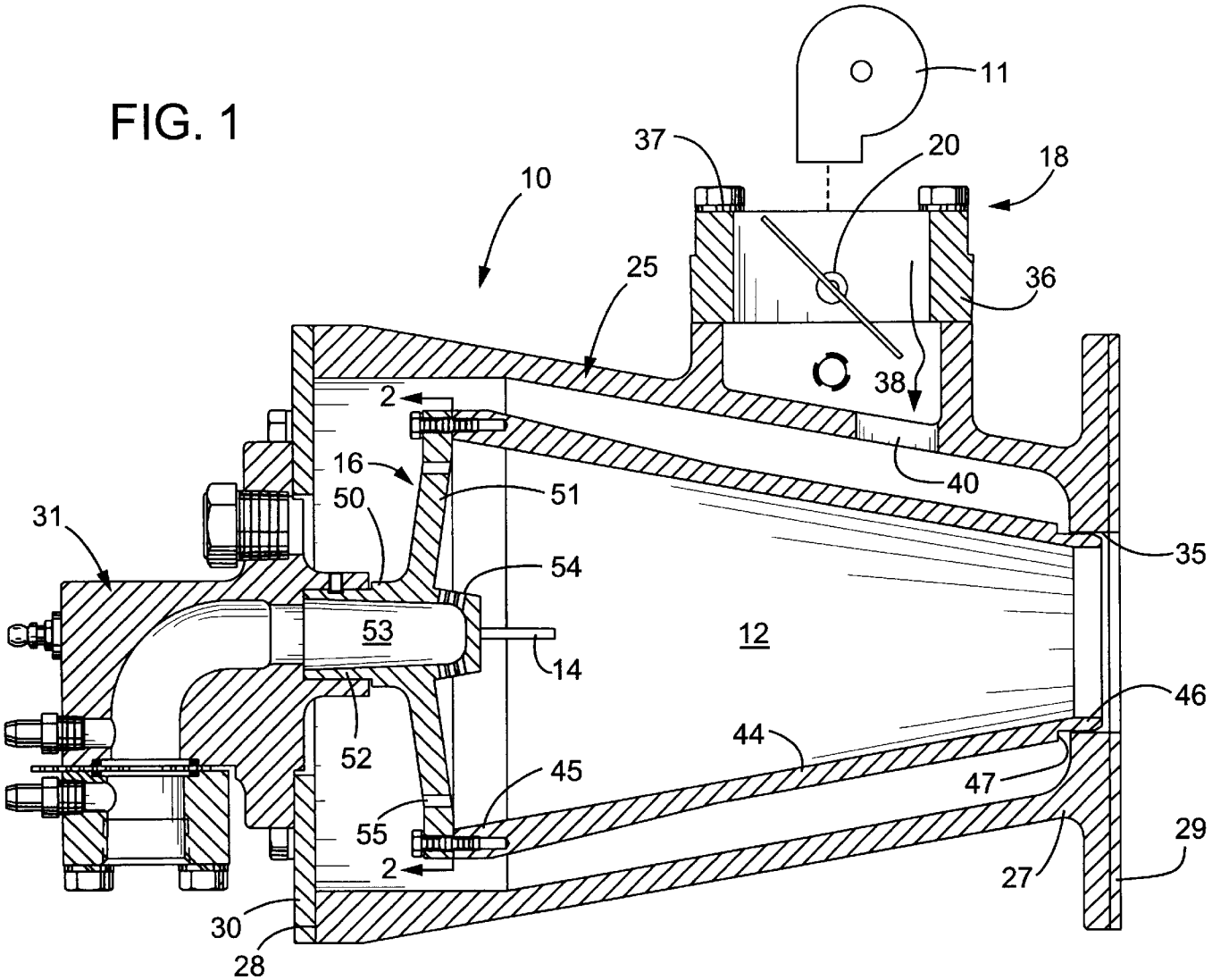
FIG. 1 is a sectional side view of a tube burner in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and specifically to FIG. 1, a gas-fired tube burner 10 is shown for providing combustion heat for heating an immersion tube located in a tank (not shown). The immersion tube heats liquid contained in the tank. Fuel and air are supplied to the burner 10 for mixing in a combustion chamber 12 to create a flammable mixture. An igniter assembly, schematically shown in FIG. 1 as reference numeral 14, is located on the combustion chamber 12 for initiating the flame. In operation, fuel and air are mixed at a burner nozzle 16 and ignited, thereby burning the air-fuel mixture.

A fan is preferably used for forcing combustion air through the burner 10. The fan 11 is connected to air inlet 18 which, in the embodiment illustrated in FIG. 1, carries a butterfly valve 20 for controlling the amount of air delivered to the burner 10. It will, however, be appreciated that the butterfly valve 20 need not be connected directly to the air inlet 18 but may be located at any point between the fan outlet and burner inlet.

When the air and fuel are mixed in appropriate proportions, the igniter 14 initiates a flame in the combustion chamber 12. Only a portion of the mixture is burned in the combustion chamber 12, however, as it is desirable to have a majority of combustion taking place in the immersion tube attached to the burner 10.

In greater detail, the burner nozzle 16 and combustion chamber 12 are disposed inside a housing 25. As best shown in FIG. 1, the housing 25 preferably has a frusto-conical side wall 26 having front and rear ends 27, 28. The shape of the side wall 26 generally corresponds to that of the combustion chamber 12. A mounting flange 29 is located on the front end 27 for attaching the burner 10 to piping or directly to a wall of the tank. In the preferred embodiment, a back plate 30 is attached to the side wall 26 at the rear end 28. The back wall 30 accommodates fuel supply apparatus 31 which delivers fuel to the burner 10.

The housing further has an air inlet 18 for allowing combustion air to enter the burner 10. In the preferred embodiment, the air inlet 18 comprises a cylindrical inlet wall 36 formed integrally with the housing 25. A free end 37 of the inlet wall 36 is adapted to be attached to a fan or additional piping which leads to a fan. The inlet wall 36 forms an inlet air passage 38 which conducts air from the fan to the interior of the housing 25. A butterfly valve 20 is centrally mounted in the inlet wall 36 to control the flow of air through the inlet air passage 38.

In carrying out the present invention, the side wall 26 is provided with a restriction orifice 40 for minimizing air pressure fluctuations through the tube burner 10. As best shown in FIG. 1, the restriction orifice 40 has a smaller cross-sectional area than the inside diameter of the inlet wall 36. Accordingly, it will be appreciated that the restriction orifice 40 creates an additional pressure drop for air entering the immersion tube burner 10.

Figure 2:
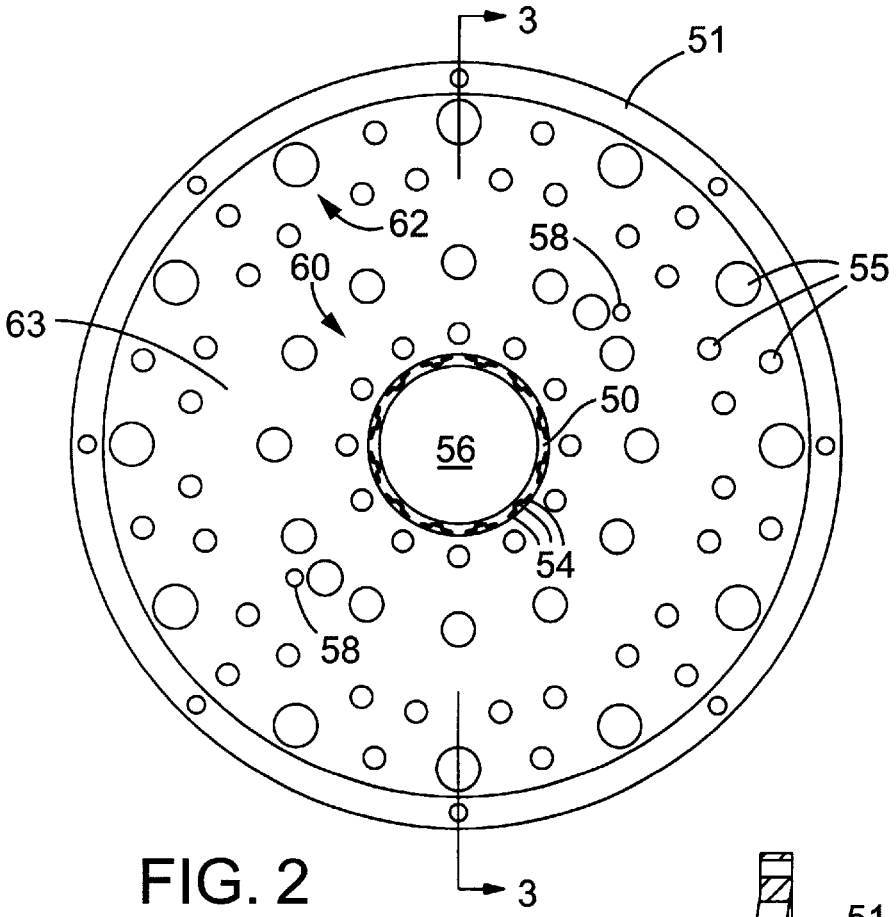
FIG. 2 is a front view of the burner nozzle taken along line 2—2 of FIG. 1.

Further in accordance with the present invention, the restriction orifice 40 is sized so that the air velocity through the orifice is greater than the velocity of air flowing through the burner nozzle 16. As described in greater detail below, the burner nozzle 16 has a plurality of holes 55 through which combustion air is allowed to pass (FIG. 2). In carrying out the present invention, the restriction orifice 40 is sized so that the cross-sectional area of the orifice is less than the sum of all the areas of the holes 55 in the burner nozzle 16.

When sizing the restriction orifice 40 and holes 55, care must be taken to account for the expansion of air as temperature increases from the restriction orifice to the holes. The increased air volume results in increased air velocities through the burner nozzle 16. Accordingly, the restriction orifice 40 not only must have a smaller area than the holes 55, but must have an area which is smaller than a fraction of the sum total of the area of all the holes 55. The exact fraction depends on the magnitude of air expansion due to increased temperature. For example, the volume of air may expand roughly four times as it travels from the restriction orifice 40 to the burner nozzle 16. A constant air-velocity is maintained at both the restriction orifice 40 and the burner nozzle 16 if the area of the restriction orifice is ¼ the size of the sum of the areas of the holes 55. In this example, therefore, the restriction orifice 40 must be even smaller than ¼ the total area of the holes 55 so that the air velocity at the restriction orifice is greater than at the burner nozzle. As noted above, the exact fraction depends on the air temperature at the nozzle and therefore the actual size of the restriction orifice 40 may be greater or less than ½ the total area of the holes 55.

It will be appreciated that the higher air velocity at the restriction orifice 40 reduces the pulsation of air pressure fluctuations between the fan and the burner nozzle. In general, the fluctuations in air pressure will travel in a direction which is the easiest to follow, i.e., the path of least resistance. The higher velocity at the restriction orifice creates a force which opposes the travel of pulsations upstream from the burner nozzle. As a result, the pulsations travel downstream of the burner nozzle rather than resonating between the fan and burner nozzle 16. Thus, the supply of combustion air is stabilized, which, in turn, stabilizes the flame produced in the burner.

A combustion sleeve 44 is provided for defining the combustion chamber 12 in which a portion of the fuel and air are mixed, burned, and directed towards the immersion tube. As best shown in FIG. 1, the combustion sleeve 44 has a generally frusto-conical shape having intake and discharge ends 45, 46. According to the illustrated embodiment, the intake end 45 is larger in diameter than the discharge end 46 and is attached to the burner nozzle 16. While various means can be used to attach the combustion sleeve 12 to the burner nozzle 16, in the currently preferred embodiment the sleeve is bolted to the burner nozzle. This method of attachment allows for easier assembly and disassembly. The discharge end 46 of the combustion sleeve 44 engages an opening 35 in the front end 27 of the housing 25. As shown best in FIG. 1, the combustion sleeve 44 has a cylindrical shoulder 47 disposed at the discharge end 46. The shoulder 47 reduces the outside diameter of the discharge end 46, thereby allowing the discharge end 46 to be inserted into the opening 35 in the housing 25. In accordance with certain aspects of the present invention, the discharge end 46 of the combustion sleeve 44 is not fixedly attached to the housing, but is allowed to slide in an axial direction along the opening 32 thereby allowing for thermal expansion of the sleeve.

The burner nozzle 16 is provided for introducing air and fuel into the combustion chamber 12. The burner nozzle 16 generally comprises a center shaft 50 and a mixing plate 51. The center shaft 50 is aligned along an axis and has attachment and discharge ends 48, 56. A recessed sleeve 52 is located at the attachment end 48 and is adapted to engage the fuel supply apparatus 31. As noted above, the combustion sleeve 44 is attached to a periphery of the mixing plate 51. Accordingly, it will be appreciated that the burner nozzle 16 is substantially coaxially aligned with the combustion sleeve 44.

Turning to the center shaft 50 of the burner nozzle 16 in greater detail, it will be noted that the center shaft generally defines a fuel inlet path 53 leading from the fuel supply apparatus 31 to a plurality of fuel outlet ports 54. As best shown with reference to FIGS. 2 and 3, fuel outlet ports 54 are spaced radially about the discharge end 56 of the center shaft 50. The fuel outlet ports 54 may be arranged in a number of different patterns and diameter sizes. In the preferred embodiment, the fuel outlet ports 54 are arranged in radially spaced groups of three, each group generally defining a triangular shape. In this manner, fuel supply to the burner nozzle 16 is dispersed about the entire radius of the discharge end 56.

The mixing plate 51 extends substantially radially from the center shaft 50 between the attachment and discharge ends 48, 56. The mixing plate 51 allows air to pass through and mix with fuel in the combustion chamber 12. As best shown in FIG. 2, a plurality of radially disposed holes 55 are located in the mixing plate 51 at various diameters. Combustion air passes through the holes 55 to mix with the fuel discharged from the fuel outlet ports 54, thereby creating a combustible mixture of air and fuel. The igniter assembly 14 extends into the combustion chamber 12 near the mixing plate 51 for initiating flame in the combustion chamber.

Figure 3:
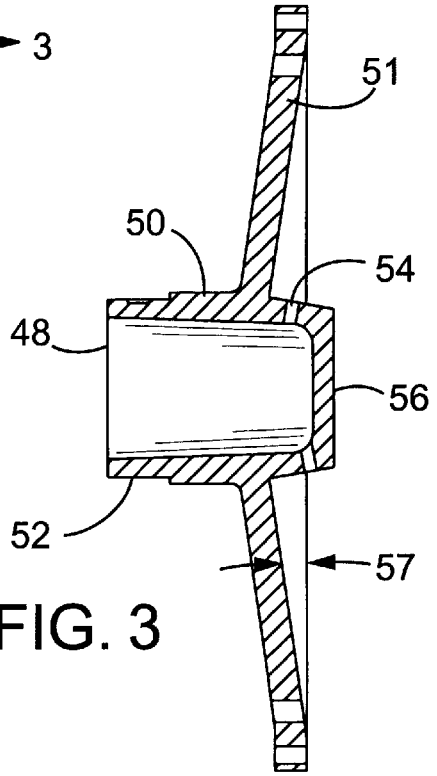
FIG. 3 is a sectional side view of the burner nozzle taken along line 3—3 of FIG. 2

The mixing plate 51 preferably has a cone shape to improve flame stability. As best shown in FIG. 3, the mixing plate 51 has an angle 57 to form a frusto-conical shape. The cone shape increases the re-circulation of hot gases to the base of the flame, thereby stabilizing the flame over a high turn down ratio. The re-circulation function is achieved over a wide range of angles for the mixing plate 51. In the preferred embodiment, the angle 57 of the mixing plate 51 is 8 degrees with respect to a plane normal to the axis of the center shaft 50.

To further stabilize the flame over a large turn down range, the holes 55 are arranged in a plurality of radially spaced zones. The holes 55 in the mixing plate 51 allow air to enter the combustion chamber 12. The holes 55 of the present invention are arranged to form a primary zone 60 located closer to the center of the mixing plate 51 and a secondary zone 62 located nearer the outer periphery of the mixing plate. The mixture of fuel and air is optimized in the primary zone 60 so that combustion takes place in the combustion chamber 12. Air and fuel from the secondary zone 62 combust in the immersion tube to thereby maximize the heating capacity of the immersion tube burner. By separating the holes 55 into radially primary and secondary zones 60, 62, the burner is better able to control the amount of combustion taking place in the combustion chamber 12 and in the immersion tube.

The holes 55 may have a wide variety of diameters and different diameter holes may be used in the same mixing plate 51. Furthermore, the holes 55 may be arranged at different diameters in the mixing plate. According to the embodiment illustrated in FIG. 2, the mixing plate 51 has various diameter holes 55 disposed at four (4) different diameters. The holes 55 at the two inner diameters make up a first or primary zone 60 and the holes 55 at the two outer diameters form a secondary zone 62. A relatively thin, annular band 63 having no holes exists between the outer diameter of the primary zone 60 and the inner diameter of the secondary zone 62 delineates the two zones.

According to a detailed aspect of the present invention, the size of the primary zone 60 is determined by the diameter of the fuel outlet ports 54. It will be appreciated by those skilled in the art that fuel exiting a circular port will maintain a relatively constant velocity and direction after leaving the port for a distance of approximately five port diameters. After traveling beyond this distance, the velocity of the fuel begins to decay and the fuel loses its original direction of travel. It will further be appreciated that optimum mixing occurs when the fuel and air are introduced normal to one another. More complete mixing therefore takes place in the burner 10 when the fuel is introduced normal to the direction of air flow, and this mixing will exist as long as the fuel maintains its velocity and direction. Since the distance at which the fuel maintains its velocity, and therefore direction, is equal to approximately five times the diameter of the fuel outlet ports 54, the primary zone 60 is located within this distance. By sizing the primary zone 60 in this manner, optimal mixing will occur within the primary zone 60 to ensure the creation of a flammable mixture over a wide turn down range.

The use of primary and secondary zones 60, 62 further allows more precise control over the amount of combustion taking place inside the combustion chamber 12 and further down in the heating tube. As noted above, it is desirable for an immersion tube burner 10 to simply initiate flame inside the burner itself and to have a majority of combustion taking place inside the immersion tube to thereby maximize the amount of heat transferred to the liquid being heated. By locating the secondary zone 62 beyond the five diameter distance, the fuel velocity will decay and be influenced by the air flow, ultimately resulting in a fuel flow directed substantially parallel to the air flow. The air and fuel from the secondary zone therefore does not mix completely in the combustion chamber but, rather, mixes in the immersion tube to create a flammable mixture. The amount of combustion taking place within the primary and secondary zones 60, 62 is controlled by the ratio of holes 55 located in each zone. For example, in the preferred embodiment, the primary zone 60 has a hole area which allows approximately 35% of the total air to pass through. The remainder of the air passes through the holes located in the secondary zone 62. As a result, roughly 35% of the combustion produced by the burner takes place in the primary zone 60 within the combustion chamber 12. At the secondary zone 62, the fuel velocity has decayed so that it travels substantially parallel to the flow of air. As a result, only minimal mixing takes place in the secondary zone and, instead, the fuel and air mix in heating tube to form a combustible mixture. Accordingly, in the preferred embodiment, roughly 65% of combustion takes place in the heating tube.

While a wide range of percentages of holes may be used in the primary zone 60, the amount of holes located in that zone must be selected so that the air-fuel mixture produced in that zone is within the flammability limits. It is well known in the art that different fuels have different flammability limits. For example, when using natural gas as the fuel, the air-fuel mixture must contain between 4 and 16% natural gas to maintain a flammable mixture. In a typical burner system, the amount of air delivered to the burner varies with the amount of fuel input. The amount of air delivered to the burner is usually adjusted so that, during high fire conditions, the percentage of fuel in the air-fuel mixture is higher, and, during low fire conditions, the percentage of fuel is lower. As a result, the upper range of the flammability limit is more likely encountered at high fire and the lower limit at low fire. When using natural gas as the fuel, the number of holes in the primary zone 60 must be selected so that the fuel-air mixture has less than 16% fuel during high fire and more than 4% fuel at low fire. As noted above, the flammability limits are different for different fuels and therefore different fuel percentages create the upper and lower limits. In the preferred embodiment, it has been found that delivering 35% of the total air to the primary zone 60 maintains combustion over a wide turn down rate.

From the foregoing, it will be appreciated that the present invention provides a new and improved immersion tube burner. The burner mixes air and fuel to obtain a combustible mixture which heats an immersion tube disposed inside a tank of liquid. The present invention incorporates a number of features in order to maintain a stable and efficient flame inside the burner. A restriction orifice is located between a fan 11 and a burner nozzle for reducing pulsations of air pressure fluctuations between the fan and the nozzle. The restriction orifice is sized so that the air velocity through the orifice is greater than the air velocity through the nozzle, thereby creating a force which opposes the travel of pulsations upstream of the burner nozzle to minimize their effect on the flame. In addition, the burner employs a mixing plate which is cone-shaped so that hot gas is recirculated back towards the burner nozzle to ensure combustion and stabilize the flame. Furthermore, the mixing plate has primary and secondary zones which ensure ignition over a wide range of firing rates and help control the amount of combustion taking place inside the combustion chamber and in the immersion tube. The primary zone is sized according to the diameter of the fuel outlet ports. The air holes in the primary zone are located within this range to optimize the mixture of air and fuel within this zone. As a result, the burner of the present invention creates a combustible mixture over a wide range of firing rates. The primary and secondary zones further delineate the amount of combustion taking place within the combustion chamber and in the heating tube. As noted above, the primary zone creates a combustible mixture which is immediately ignited inside the combustion chamber. The air holes of the secondary zone are located at a distance from the fuel outlet ports so that the velocity of the fuel is substantially decayed by the time it reaches that zone. As a result, the fuel and air at the secondary zone follow substantially parallel paths and do not mix inside the combustion chamber. Instead, air and fuel from the secondary zone mix inside the serpentine heating tube to subsequently combust inside the tube, thereby increasing the heating efficiency of the immersion tube burner.

What is claimed is:

1. A burner for producing an air and fuel mixture and combusting the mixture down an immersion tube, the burner comprising:

a housing having a front and rear ends, the rear end including means for mounting fuel supply apparatus to the housing, the housing further having an air inlet, and a discharge outlet, a fan connected to the air inlet for supplying air to the burner, a combustion sleeve mounted inside the housing having an inlet end and an outlet end, the outlet end engaging the discharge outlet of the housing, an igniter extending into the combustion sleeve, and a burner nozzle for mixing the fuel and air, the burner nozzle having a center shaft aligned along an axis and a nixing plate, the center shaft having an attachment end sized to accept fuel supply apparatus near the rear end of the housing and a mixing end carrying a plurality of fuel outlet ports for delivering fuel inside the combustion sleeve, the mixing plate extending radially from the center shaft between the attachment and mixing ends, a periphery of the mixing plate connected-to the inlet end of the combustion sleeve, a plurality of holes extending through the mixing plate to allow air to pass therethrough, wherein the housing has a restriction orifice located at the air inlet, the restriction orifice creating a pressure drop which reduces air pressure fluctuations pulsating between the fan and the burner nozzle, thereby reducing flame instability.

2. The Burner of claim 1 in which the restriction orifice is sized so that air passing through the orifice has an inlet velocity which is greater than nozzle velocity of air through said holes through the mixing plate in the burner nozzle.

3. The burner of claim 1 in which the combustion sleeve is frusto-conical.

4. The burner of claim 1 in which the mixing plate forms an angle with respect to a plane normal to the axis of the center shaft to thereby form a cone.

5. The burner of claim 4 in which the angle is about 8 degrees.

6. The burner of claim 1 in which the holes of the mixing plate are arranged to form a primary zone and a secondary zone, the primary zone located nearest the fuel outlet ports, the secondary zone located near a periphery of the mixing plate, wherein immediate mixing of fuel and air takes place in the primary zone, fuel and air in the secondary zone mixing farther downstream.

7. The burner of claim 6 in which the fuel outlet ports have a given diameter, the holes in the primary zone located within a distance equal to about five times the diameter of the fuel outlet ports.

8. The burner of claim 6 in which the holes of the primary zone constitute about 35% of a total hole area of the mixing plate.

9. A burner for producing an air and fuel mixture and combusting the mixture down an immersion tube, the burner comprising:

a housing having a front and rear ends, the rear end including means for mounting fuel supply apparatus to the housing, the housing further having an air inlet, and a discharge outlet, a fan connected to the air inlet for supplying air to the burner, a combustion sleeve mounted inside the housing having an inlet end and an outlet end, the outlet end engaging the discharge outlet of the housing, an igniter extending into the combustion sleeve, and a burner nozzle for mixing the fuel and air, the burner nozzle having a center shaft aligned along an axis and a mixing plate, the center shaft having an attachment end sized to accept fuel supply apparatus near the rear end of the housing and a mixing end carrying a plurality of fuel outlet ports for delivering fuel inside the combustion sleeve, the mixing plate extending radially from the center shaft between the attachment and mixing ends, a periphery of the mixing plate connected to the inlet end of the combustion sleeve, a plurality of holes extending through the mixing plate to allow air to pass therethrough, wherein the holes of the mixing plate are arranged to form a primary zone including holes aligned substantially between adjacent fuel outlet ports and a secondary zone including holes aligned substantially with individual outlet ports, the primary zone located nearest the fuel outlet ports, the secondary zone located near a periphery of the mixing plate, immediate mixing of fuel and air taking place in the primary zone, fuel and air in the secondary zone mixing farther downstream.

10. The burner of claim 9 in which the primary zone is located within a distance from the fuel outlet ports, the distance equal to about five times a diameter of the fuel outlet ports.

11. The burner of claim 9 in which the mixing plate forms an angle with respect to a plane normal to the axis of the center shaft to thereby form a cone.

12. The burner of claim 11 in which the angle is about 8 degrees.

13. The burner of claim 9 in which the fuel outlet ports are aligned to discharge substantially normal to a direction of air flow through the mixing plate.

14. The burner of claim 9 in which the fuel outlet ports have a discharge angle of roughly 92 degrees with respect to a direction of air flow through the mixing plate.

15. The burner of claim 9 in which the holes of the primary zone constitute about 35% of the total hole area of the mixing plate.

16. The burner of claim 9 in which the housing has a restriction orifice located at the air inlet, the restriction having a diameter sized so that air flow velocity through the restriction orifice is greater than air flow velocity through the mixing plate.

* * * * *